United States Patent [19]

Drouin

[11] 4,023,380

[45] May 17, 1977

[54] EVAPORATION TRAY FOR REFRIGERATORS

[75] Inventor: Clause Drouin, Montmagny, Canada

[73] Assignee: Les Industries Bfg Limitee, Montmagny, Canada

[22] Filed: Jan. 22, 1976

[21] Appl. No.: 651,418

[30] Foreign Application Priority Data

Jan. 15, 1976 Canada ..... 243888

[52] U.S. Cl. ..... 62/279

[51] Int. Cl.[2] ..... F25B 47/00

[58] Field of Search ..... 62/277, 279, 441

[56] References Cited

UNITED STATES PATENTS

| | | | |
|---|---|---|---|
| 2,562,811 | 7/1951 | Muffly | 62/279 |
| 2,594,073 | 4/1952 | Robbins | 62/279 |
| 2,667,765 | 2/1954 | Harris et al. | 62/279 |
| 2,907,180 | 10/1959 | Mann | 62/441 |
| 2,941,381 | 6/1960 | Eberhart | 62/279 |
| 3,225,563 | 12/1965 | Braun | 62/277 |
| 3,403,529 | 10/1968 | Reber, Jr. | 62/277 |
| 3,797,269 | 3/1974 | DeJarlais | 62/279 |

*Primary Examiner*—Lloyd L. King

[57] ABSTRACT

The disclosure herein describes an evaporation tray made in a single piece of molded plastic that includes a series of posts for mounting the compressor above the bottom wall of the tray so that water collected therebeneath may be evaporated by the heat dissipated by the compressor; well means integrally mounted to the bottom wall of the tray serve to collect water formed from melted frost through a drain tube which has its lower extremity securely received in the well means; the drain tube and the well means are arranged to retain water which thus prevents an air return flow through the drain tube inside the refrigerator.

8 Claims, 5 Drawing Figures

EVAPORATION TRAY FOR REFRIGERATORS

FIELD OF THE INVENTION

The present invention relates generally to household refrigerators and more particularly, to a tray for the evaporation of water formed from melted ice and frost.

BACKGROUND OF THE INVENTION

Present day household refrigerators usually include in its lower portion an uninsulated space in which a compressor and/or a condenser are housed together with a drip pan. An example of such refrigerator is disclosed in Canadian Pat. No. 703,567 issued Feb. 9, 1965. A drain tube is usually provided to discharge melted frost water into the pan where it receives heat from the condenser and the motor compressor unit in an amount sufficient to cause evaporation of the water collected in the pan at rates sufficient to keep the pan from overflowing. In some cases, such as disclosed in U.S. Pat. No. 2,907,180 issued Oct. 6, 1959, there is provided in the machine compartment housing the condenser and the compressor, some means providing a water seal so that air will not be drawn up from the machine compartment through the discharge tube into the refrigerator.

OBJECTS OF THE INVENTION

An object of the present invention is to provide an improved molded plastic evaporation tray for collecting and evaporating the defrost water of a household refrigerator.

It is a further object of this invention to provide a molded plastic tray in which are integrally formed mounting posts for the compressor and well means for retaining a portion of the defrost water to form a water seal.

Another object of this invention is to provide a molded plastic evaporation tray where the lower extremity of the drain tube is securely maintained in the well means.

STATEMENT OF THE INVENTION

The present invention therefore relates to an evaporation tray for use in a refrigerator equipped with a compressor and a drain tube, which comprises: a molded plastic body having a bottom wall and upwardly extending peripheral sidewalls; a series of mounting posts integral with the bottom wall and being disposed on this bottom wall to mount the compressor above a portion of the bottom wall; and well means integral with the bottom wall for containing the defrost water discharged from the drain tube, the well means serving to form a water seal to prevent air return through said drain tube into other compartments of the refrigerator.

In one preferred form of the invention, the evaporation tray may be fixedly mounted to the base of the lower compartment of the refrigerator. The mounting posts of the tray have hollow interior profiles to receive therein means for securing the tray to the refrigerator base, the securing means further serving as reinforcements for the mounting posts.

Other objects and further scope of applicability of the present invention will become apparent from the detailed description given hereinafter; it should be understood, however, that the detailed description, while indicating preferred embodiment of the invention, is given by way of illustration only, since various changes and modifications within the spirit and scope of the invention will become apparent to those skilled in the art from this detailed description.

DESCRIPTION OF PREFERRED EMBODIMENTS

Figure 1:
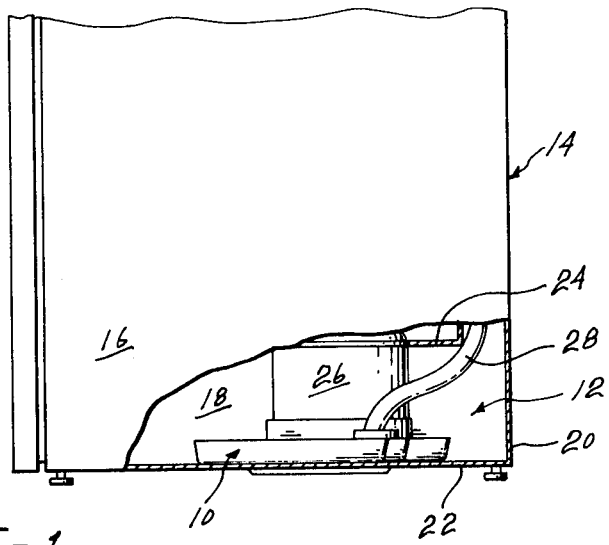
FIG. 1 is a fragmentary view of the lower portion of a refrigerator unit showing the evaporation tray of the present invention disposed in its lower compartment.

Referring now more particularly to the drawings, the evaporation tray 10 of the present invention is housed in the uninsulated lower compartment 12 of a refrigerator 14. This compartment 12 is defined by sidewalls 16 and 18, rear wall 20, base 22 and by the upper dividing wall 24 adjacent the fresh food compartment (not shown) of the refrigerator. Together with the evaporation tray 10, a compressor 26 is housed in compartment 12. The defrosting components of the refrigerator unit 14 are not part of the present invention; they may be of the type disclosed in the above mentioned Canadian Pat. No. 703,567. These components accomplish periodic defrosting resulting in melted ice and frost which must be discharged to the evaporation tray. This discharging is achieved by means of a drain tube 28 made of flexible material directing the defrost water to the evaporation tray 10.

The tray 10 is formed from a single sheet of plastic material which, in the preferred form, is a thermoset plastic material such as high impact styrene having a thickness of about 0.062 inch and manufactured by a suitable process such as molding. The tray 10 has a bottom wall 30 and an upstanding continuous peripheral wall 32 forming front, rear and sidewalls. The bottom wall 30 includes a centrally located recessed portion 34 of circular configuration. Disposed adjacent the recessed portion 34 are four mounting posts 36, 37, 38 and 39 which are integrally formed with the bottom wall 30 of the tray. The portion of bottom wall 30 adjacent the mounting posts is thicker somewhat to provide reinforcement (see FIG. 2). In the embodiment illustrated in the drawings, a series of annular lugs 40 are inserted over the vertical post and are attached thereto by means of clips 42 snuggly received in groove 44 provided in the upper portion of the posts. The outside wall of annular lugs 40 are shaped with a groove 46 to receive a portion of supporting plate 48 on which is mounted the compressor 26. Plate 48 is adequately structured so that heat dissipated from the compressor may freely circulate over the recessed portion 34 of the tray bottom wall.

The evaporation tray 10 may be fixedly mounted to the base 22 of the refrigerator. Therefore, the vertical posts 36- 39 include a hollow profile 50 to receive therein fastening means, such as screws 52; these fastening means serve also to reinforce the plastic posts. In the case where the tray is directly secured to the base of the lower compartment of the refrigerator, base 22 may also include a recessed portion 53 to suit the correspondingly shaped portion 34 of the tray.

Figure 2:
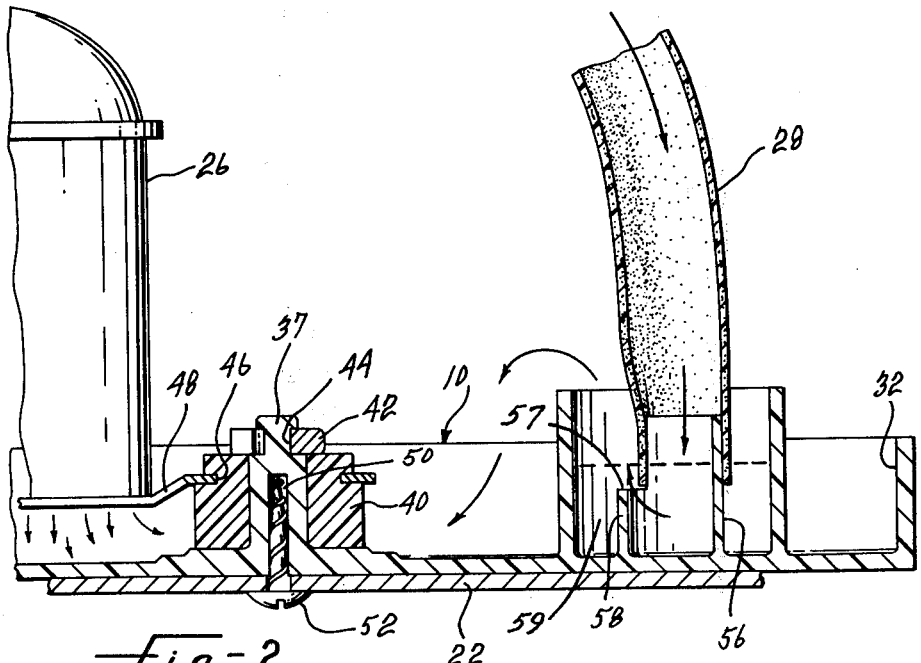
FIG. 2 is an elevational cross-sectional view asseen from lines 2—2 of FIG. 3.
Figures 3, 4, 5:
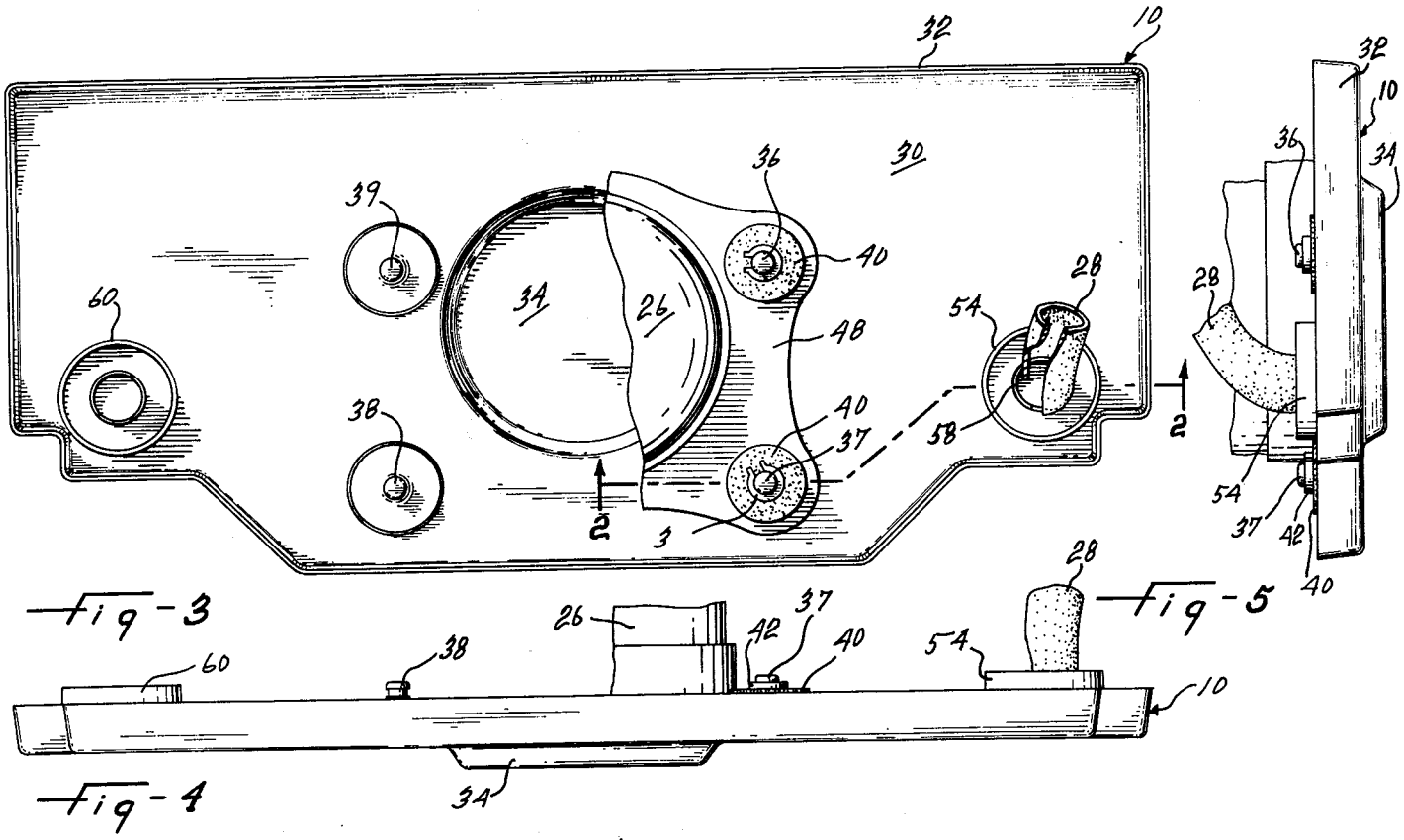
FIG. 3 is a top plan view of the evaporation tray showing in part the compressor mounted on the mounting posts of the tray.
FIG. 4 is an elevational view of the tray shown in FIG. 3.
FIG. 5 is an end elevational view of the tray shown in FIG. 3.

The evaporation tray of the present invention further includes, integrally mounted to its bottom wall, one or more wells 54 which serve to receive the defrost water discharged through the drain tube 28. Each well is cylindrically shaped and includes centrally therein and also integrally mounted to the bottom wall of the tray, a vertical generally cylindrical extension 56 of slightly larger diameter than the inner diameter of the drain tube. The upper portion of extension 56 has a cut-out portion 57 to receive the lower extremity of the drain tube. Since the inner diameter of the tube is smaller than the outer diameter of the upper part 57, the tube must be stretched before it may be snuggly engaged with the central portion 56. The cut-out portion allows water circulation from within part 56 to adjacent well space 59. The lower part 58 of portion 56 serves also as a stop for limiting the insertion of the tube on part 56. As illustrated by the arrows of FIG. 2 the defrost water is discharged from the drain tube 28 into the well 54 where it is retained until it overflows the upper edge of the well. The lower extremity of the drain tube 28 extends below the upper edge of the well 54 to ensure a water seal in the well when water exceeds the discharging level of part 56 into well 54 to prevent air from compartment 12 to return into the other compartments of the refrigerator.

A second well of identical construction to the well 54 is shown in the drawings on the opposite side of the compressor to suit various arrangements of drain systems on various types of refrigerators.

What is claimed is:

1. An evaporation tray for use in a refrigerator equipped with a compressor and a drain tube for draining water formed from melted frost, comprising: a molded plastic body having a bottom wall and upwardly extending peripheral sidewalls; a series of mounting posts integral with said bottom wall and extending upwardly therefrom, said compressor being mounted on said posts above a portion of said bottom wall; and well means integral with said bottom wall for receiving said water discharged from said drain tube and for retaining therein a portion of said water to form a water seal.

2. An evaporation tray as defined in claim 1, wherein said portion of said bottom wall extending below said compressor is recessed with respect to the overall plane of said bottom wall whereby water received on said bottom wall as a result of overflow of said water from said well means may be collected in said recessed portion and evaporated by heat dissipated from said compressor.

3. An evaporation tray as defined in claim 1, further comprising means in said well means for securing the lower extremity of said drain tube in said well means.

4. An evaporation tray as defined in claim 3, wherein said securing means include means for limiting the insertion of said drain tube in said well means whereby said lower extremity is received in said well means in a plane lower than the plane of the upper edge of the well means, but higher than the plane of the bottom of said well means.

5. In a refrigerator unit having a lower compartment, the combination in said compartment comprising: an evaporation tray consisting of a one-piece molded plastic body having a bottom wall and upwardly extending peripheral sidewalls; a series of mounting posts integral with said bottom wall; a compressor mounted on said posts and extending slightly above said bottom wall; well means integral with said bottom wall; a drain tube having its lowermost extremity received in said well means for directing thereto water formed from melted frost; said water received in said well means forming a water seal to prevent air return from said compartment through said drain tube; a portion of said bottom wall located beneath said compressor being shaped to collect water overflowing the upper edge of said well means whereby heat dissipated from said compressor serves in the evaporation of said water received in said bottom wall portion.

6. In a refrigerator unit as defined in claim 5, said posts having a hollow portion extending vertically therein; said lower compartment of said refrigeration having a base; and releasable fastening means in said hollow portion for securing said tray to said base, said fastening means further serving as reinforcements for said mounting posts.

7. In a refrigerator unit as defined in claim 5, further comprising attachment means mounted to said posts; a plate for supporting said compressor mounted to said attachment means; and releasable connecting means for securing said attachment means to said posts.

8. A refrigerator unit as defined in claim 7, said well means including means for securing the lower extremity of said drain tube in said well means; said securing means including means for limiting the insertion of the lower extremity of said drain tube in said well means; said lower extremity of said drain tube being in a plane lower than the plane extending through the upper edge of said well means and in a plane higher than the plane including the bottom of said well means whereby water retained in said well means serves as a water seal for air return from said lower compartment through said drain tube.

* * * * *